US011828521B2

(12) United States Patent
Gotanda

(10) Patent No.: US 11,828,521 B2
(45) Date of Patent: Nov. 28, 2023

(54) CRYOPUMP

(71) Applicant: SUMITOMO HEAVY INDUSTRIES, LTD., Tokyo (JP)

(72) Inventor: Shuhei Gotanda, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 608 days.

(21) Appl. No.: 17/010,429

(22) Filed: Sep. 2, 2020

(65) Prior Publication Data

US 2020/0400365 A1 Dec. 24, 2020

Related U.S. Application Data

(63) Continuation of application No. PCT/JP2019/007522, filed on Feb. 27, 2019.

(30) Foreign Application Priority Data

Mar. 2, 2018 (JP) ..... 2018-037187

(51) Int. Cl.
*F25D 19/00* (2006.01)
*F04B 37/08* (2006.01)
(Continued)

(52) U.S. Cl.
CPC ..... *F25D 19/006* (2013.01); *F04B 37/08* (2013.01); *F25D 21/14* (2013.01); *F25B 9/145* (2013.01)

(58) Field of Classification Search
CPC ..... F25D 19/006; F25D 21/14; F04B 37/08; F04B 37/02; F04B 37/16; F04B 37/14;
(Continued)

(56) References Cited

U.S. PATENT DOCUMENTS 5,111,667 A * 5/1992 Hafner ..... F25D 19/006 62/55.5
2007/0295599 A1* 12/2007 Tsuyuki ..... C23C 14/34 204/192.1
2017/0284384 A1 10/2017 Oikawa

FOREIGN PATENT DOCUMENTS

JP H01-080681 U 5/1989
JP H10-184540 A 7/1998
(Continued)

OTHER PUBLICATIONS

International Search Report issued in Application No. PCT/JP2019/007522, dated Jun. 4, 2019.
(Continued)

*Primary Examiner* — Ana M Vazquez
(74) *Attorney, Agent, or Firm* — Michael Best & Friedrich LLP

(57) ABSTRACT

A cryopump includes: a cryocooler which includes a high-temperature cooling stage and a low-temperature cooling stage; a radiation shield which surrounds the low-temperature cooling stage, extends in an axial direction, and is thermally coupled to the high-temperature cooling stage; a plurality of adsorption cryopanels which are disposed between a cryopump intake port and the low-temperature cooling stage in the axial direction and are thermally coupled to the low-temperature cooling stage; and a condensation cryopanel which is disposed between the radiation shield and the plurality of adsorption cryopanels in a radial direction, is thermally coupled to the low-temperature cooling stage, and has a tubular shape extending in the axial direction and being open at both ends.

9 Claims, 5 Drawing Sheets

(51) Int. Cl.
*F25B 9/14* (2006.01)
*F25D 21/14* (2006.01)

(58) Field of Classification Search
CPC .... F25B 9/145; F25B 9/14; F25B 9/10; F05B 2210/12
See application file for complete search history.

(56) References Cited

FOREIGN PATENT DOCUMENTS

| | | | |
|---|---|---|---|
| JP | 2010-048132 | A | 3/2010 |
| JP | 2017-180451 | A | 10/2017 |

OTHER PUBLICATIONS

International Preliminary Report on Patentability issued in Application No. PCT/JP2019/007522, dated Sep. 8, 2020.

* cited by examiner

CRYOPUMP

RELATED APPLICATIONS

The contents of Japanese Patent Application No. 2018-037187, and of International Patent Application No. PCT/JP2019/007522, on the basis of each of which priority benefits are claimed in an accompanying application data sheet, are in their entirety incorporated herein by reference.

BACKGROUND

Technical Field

Certain embodiments of the present invention relate to a cryopump.

Description of Related Art

A cryopump is a vacuum pump which captures gas molecules on a cryopanel cooled to a cryogenic temperature by condensation or adsorption to exhaust the gas molecules. The cryopump is generally used to realize a clean vacuum environment which is required for a semiconductor circuit manufacturing process or the like.

SUMMARY

According to an embodiment of the present invention, there is provided a cryopump including: a cryocooler which includes a high-temperature cooling stage and a low-temperature cooling stage; a radiation shield which surrounds the low-temperature cooling stage, extends in an axial direction, and is thermally coupled to the high-temperature cooling stage; a plurality of adsorption cryopanels which are disposed between a cryopump intake port and the low-temperature cooling stage in the axial direction and are thermally coupled to the low-temperature cooling stage; and a condensation cryopanel which is disposed between the radiation shield and the plurality of adsorption cryopanels in a radial direction, is thermally coupled to the low-temperature cooling stage, and has a tubular shape extending in the axial direction and being open at both ends.

DETAILED DESCRIPTION

Figure 1:
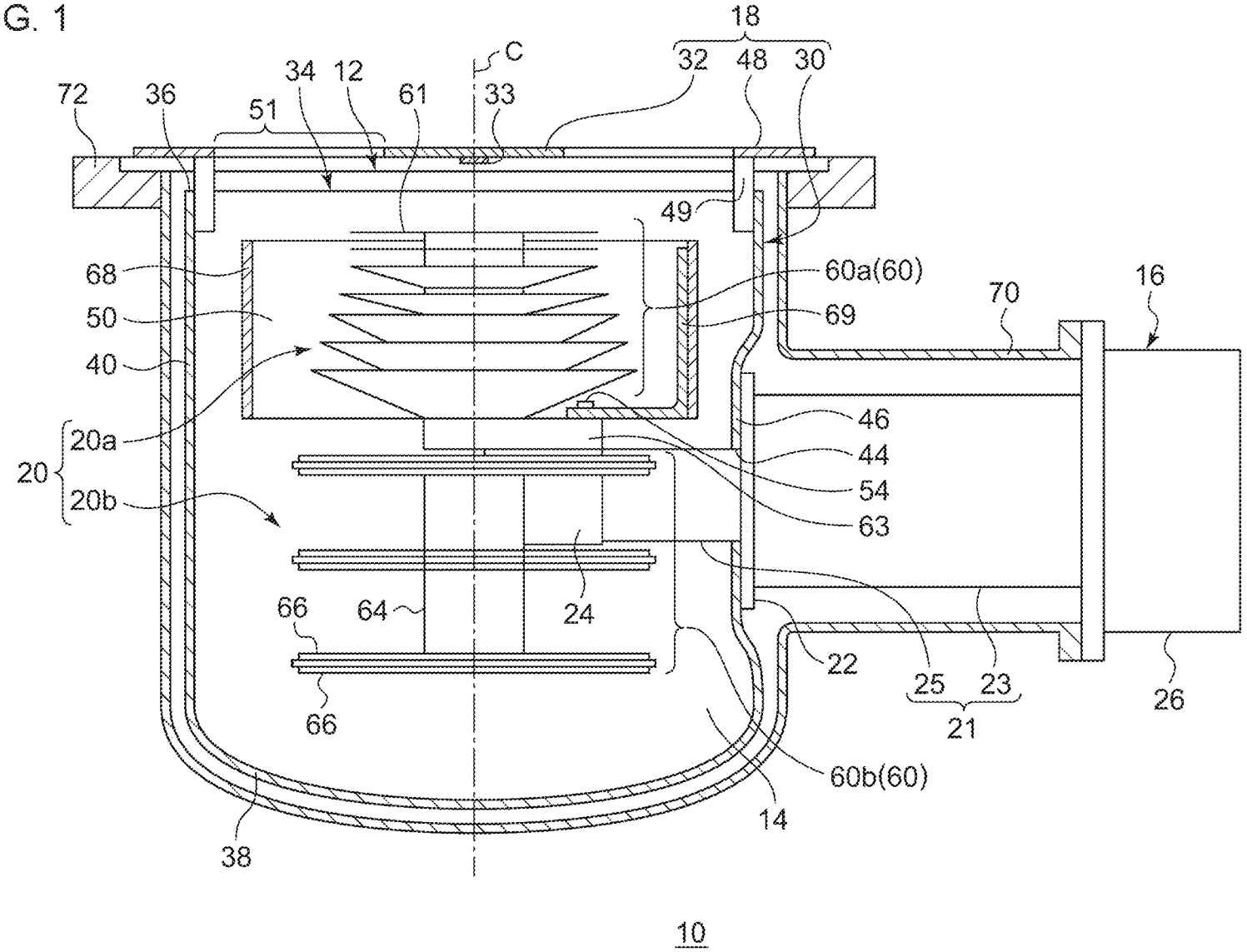
FIG. 1 is a side sectional view schematically showing a cryopump according to an embodiment.

A gas which is exhausted by a cryopump is roughly classified into three types: a first type gas, a second type gas, and a third type gas, according to a vapor pressure. These three types are sometimes called a type 1 gas, a type 2 gas, and a type 3 gas. The type 1 gas has the lowest vapor pressure, and a typical example thereof is water (water vapor). The type 2 gas has an intermediate vapor pressure and includes, for example, a nitrogen gas or an argon gas. The type 3 gas has the highest vapor pressure, and a typical example thereof is a hydrogen gas. The type 2 gas can be exhausted by condensing on a cryogenic surface cooled to about 20 K or less, and the type 3 gas can be exhausted by being adsorbed to an adsorbent such as activated carbon which is installed on such a cryogenic surface and cooled. The type 3 gas is also called a non-condensable gas.

In the existing design of a cryopump suitable for the exhaust of the type 3 gas, although the type 3 gas can be exhausted at a high exhaust speed, the exhaust performance (for example, exhaust speed) of the type 2 gas tends to be kept low.

It is desirable to improve the exhaust performance of the type 2 gas while realizing the high-speed exhaust of the type 3 gas.

Any combination of the constituent elements described above, or replacement of constituent elements or expressions of the present invention with each other between methods, apparatuses, systems, or the like is also valid as an aspect of the present invention.

According to the present invention, it is possible to improve the exhaust performance of the type 2 gas while realizing the high-speed exhaust of the type 3 gas.

Hereinafter, modes for carrying out the present invention will be described in detail with reference to the drawings. In the description and the drawings, identical or equivalent constituent elements, members, and processing are denoted by the same reference numerals, and overlapping description is omitted appropriately. The scales or shapes of the respective parts shown in the drawings are set for convenience in order to facilitate description and are not interpreted to a limited extent unless otherwise specified. Embodiments are exemplification and do not limit the scope of the present invention. All features described in the embodiments or combinations thereof are not necessarily essential to the invention.

Figure 2:
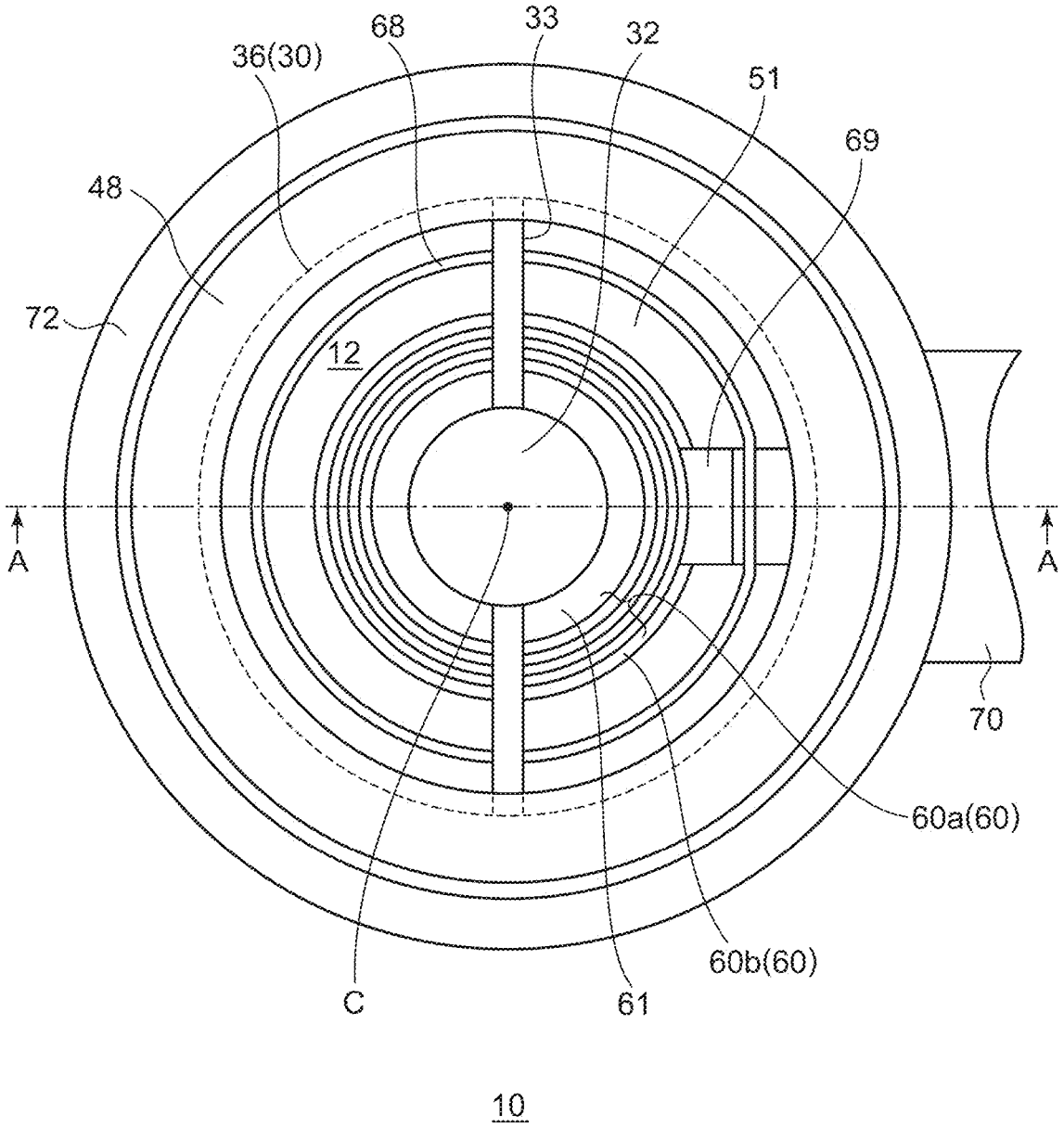
FIG. 2 is a top view schematically showing the cryopump shown in FIG. 1.

FIG. 1 is a side sectional view schematically showing a cryopump 10 according to an embodiment. FIG. 2 is a top view schematically showing the cryopump 10 shown in FIG. 1. In FIG. 1, a cross section taken along line A-A shown in FIG. 2 including a cryopump central axis (hereinafter, also simply referred to as a central axis) C is shown. For easy understanding, the central axis C is shown by a dashed line in FIG. 1. Further, in FIG. 1, a low-temperature cryopanel part of the cryopump 10 and a cryocooler are shown not in cross section but in side view.

The cryopump 10 is mounted to a vacuum chamber of, for example, an ion implanter, a sputtering apparatus, a vapor deposition apparatus, or other vacuum process equipment and is used to increase the degree of vacuum in the interior of the vacuum chamber to a level which is required for a desired vacuum process. The cryopump 10 has a cryopump intake port (hereinafter, also simply referred to as an "intake port") 12 for receiving a gas to be exhausted, from the vacuum chamber. The gas enters an internal space 14 of the cryopump 10 through the intake port 12.

In the following, there is a case where the terms "axial direction" and "radial direction" are used in order to express the positional relationship between constituent elements of the cryopump 10 in an easily understandable manner. The axial direction of the cryopump 10 represents a direction passing through the intake port 12 (that is, a direction along the central axis C in the drawings), and the radial direction represents a direction along the intake port 12 (a direction perpendicular to the central axis C). For convenience, with respect to the axial direction, there is a case where the side relatively close to the intake port 12 is referred to as an "upper side" and the side relatively distant from the intake port 12 is referred to as a "lower side". That is, there is a case where the side relatively distance from the bottom of the cryopump 10 is referred to as an "upper side" and the side relatively close to the bottom of the cryopump 10 is referred to as a "lower side". With respect to the radial direction, there is a case where the side close to the center (in the drawings, the central axis C) of the intake port 12 is referred to as an "inner side" and the side close to the peripheral edge of the intake port 12 is referred to as an "outer side". Such expressions are not related to the disposition when the cryopump 10 is mounted to the vacuum chamber. For example, the cryopump 10 may be mounted to the vacuum chamber with the intake port 12 facing downward in the vertical direction.

Further, there is a case where a direction surrounding the axial direction is referred to as a "circumferential direction". The circumferential direction is a second direction along the intake port 12 and is a tangential direction orthogonal to the radial direction.

The cryopump 10 includes a cryocooler 16, a first-stage cryopanel 18, a second-stage cryopanel assembly 20, and a cryopump housing 70. The first-stage cryopanel 18 may be referred to as a high-temperature cryopanel part or a 100 K part. The second-stage cryopanel assembly 20 may be referred to as a low-temperature cryopanel part or a 10 K part.

The cryocooler 16 is a cryocooler such as a Gifford McMahon type cryocooler (a so-called GM cryocooler), for example. The cryocooler 16 is a two-stage cryocooler. Therefore, the cryocooler 16 includes a first cooling stage 22 and a second cooling stage 24. The cryocooler 16 is configured to cool the first cooling stage 22 to a first cooling temperature and cool the second cooling stage 24 to a second cooling temperature. The second cooling temperature is lower than the first cooling temperature. For example, the first cooling stage 22 is cooled to a temperature in a range of about 65 K to 120 K, preferably, in a range of 80 K to 100 K, and the second cooling stage 24 is cooled to a temperature in a range of about 10 K to 20 K. The first cooling stage 22 and the second cooling stage 24 may be referred to as a high-temperature cooling stage and a low-temperature cooling stage, respectively.

Further, the cryocooler 16 includes a cryocooler structure part 21 that structurally supports the second cooling stage 24 on the first cooling stage 22 and structurally supports the first cooling stage 22 on a room temperature part 26 of the cryocooler 16. Therefore, the cryocooler structure part 21 includes a first cylinder 23 and a second cylinder 25 that extend coaxially along the radial direction. The first cylinder 23 connects the room temperature part 26 of the cryocooler 16 to the first cooling stage 22. The second cylinder 25 connects the first cooling stage 22 to the second cooling stage 24. The room temperature part 26, the first cylinder 23, the first cooling stage 22, the second cylinder 25, and the second cooling stage 24 are linearly arranged in this order.

A first displacer and a second displacer (not shown) are reciprocally disposed in the interiors of the first cylinder 23 and the second cylinder 25, respectively. A first regenerator and a second regenerator (not shown) are respectively incorporated into the first displacer and the second displacer. Further, the room temperature part 26 has a drive mechanism (not shown) for reciprocating the first displacer and the second displacer. The drive mechanism includes a flow path switching mechanism that switches a flow path of a working gas (for example, helium) so as to periodically repeat the supply and discharge of the working gas to and from the interior of the cryocooler 16.

The cryocooler 16 is connected to a compressor (not shown) for the working gas. The cryocooler 16 cools the first cooling stage 22 and the second cooling stage 24 by expanding the working gas pressurized by the compressor in the interior thereof. The expanded working gas is recovered to the compressor and pressurized again. The cryocooler 16 generates cold by repeating a heat cycle including the supply and discharge of the working gas and the reciprocation of the first displacer and the second displacer in synchronization with the supply and discharge of the working gas.

The cryopump 10 which is shown in the drawing is a so-called horizontal cryopump. The horizontal cryopump is generally a cryopump in which the cryocooler 16 is disposed so as to intersect (usually, be orthogonal to) the central axis C of the cryopump 10.

The first-stage cryopanel 18 includes a radiation shield 30 and an inlet cryopanel 32 and surrounds the second-stage cryopanel assembly 20. The first-stage cryopanel 18 provides a cryogenic surface for protecting the second-stage cryopanel assembly 20 from radiant heat outside the cryopump 10 or from the cryopump housing 70. The first-stage cryopanel 18 is thermally coupled to the first cooling stage 22. Accordingly, the first-stage cryopanel 18 is cooled to the first cooling temperature. The first-stage cryopanel 18 has a gap between itself and the second-stage cryopanel assembly 20, and the first-stage cryopanel 18 is not in contact with the second-stage cryopanel assembly 20. The first-stage cryopanel 18 is also not in contact with the cryopump housing 70.

The radiation shield 30 is provided to protect the second-stage cryopanel assembly 20 from the radiant heat of the cryopump housing 70. The radiation shield 30 extends in a tubular shape (for example, a cylindrical shape) in the axial direction from the intake port 12. The radiation shield 30 is located between the cryopump housing 70 and the second-stage cryopanel assembly 20 and surrounds the second-stage cryopanel assembly 20. The radiation shield 30 has a shield main opening 34 for receiving gas from the outside of the cryopump 10 into the internal space 14. The shield main opening 34 is located at the intake port 12.

The radiation shield 30 is provided with a shield front end 36 defining the shield main opening 34, a shield bottom portion 38 which is located on the side opposite to the shield main opening 34, and a shield side portion 40 connecting the shield front end 36 to the shield bottom portion 38. The shield side portion 40 extends in the axial direction from the shield front end 36 to the side opposite to the shield main opening 34, and extends so as to surround the second cooling stage 24 in the circumferential direction.

The shield side portion 40 has a shield side portion opening 44 into which the cryocooler structure part 21 is inserted. The second cooling stage 24 and the second cylinder 25 are inserted into the radiation shield 30 from outside the radiation shield 30 through the shield side portion opening 44. The shield side portion opening 44 is a mounting hole formed in the shield side portion 40 and is, for example, circular. The first cooling stage 22 is disposed outside the radiation shield 30.

The shield side portion 40 is provided with a mounting seat 46 for the cryocooler 16. The mounting seat 46 is a flat portion for mounting the first cooling stage 22 to the radiation shield 30, and is slightly depressed when viewed from outside the radiation shield 30. The mounting seat 46 forms the outer periphery of the shield side portion opening 44. The first cooling stage 22 is mounted to the mounting seat 46, whereby the radiation shield 30 is thermally coupled to the first cooling stage 22.

Instead of directly mounting the radiation shield 30 to the first cooling stage 22 in this manner, in an embodiment, the radiation shield 30 may be thermally coupled to the first cooling stage 22 through an additional heat transfer member. The heat transfer member may be, for example, a hollow short cylinder having flanges at both ends. The heat transfer member may be fixed to the mounting seat 46 by the flange at one end and fixed to the first cooling stage 22 by the flange at the other end. The heat transfer member may extend from the first cooling stage 22 to the radiation shield 30 to surround the cryocooler structure part 21. The shield side portion 40 may include such a heat transfer member.

In the illustrated embodiment, the radiation shield 30 is configured in an integral tubular shape. Instead, the radiation shield 30 may be configured to have a tubular shape as a whole by a plurality of parts. The plurality of parts may be disposed with a gap therebetween. For example, the radiation shield 30 may be divided into two parts in the axial direction.

The inlet cryopanel 32 is provided in the intake port 12 (or the shield main opening 34, the same applies hereinafter) in order to protect the second-stage cryopanel assembly 20 from the radiant heat from a heat source outside the cryopump 10 (for example, a heat source in the vacuum chamber to which the cryopump 10 is mounted). Further, gas (for example, moisture) condensing at the cooling temperature of the inlet cryopanel 32 is captured on the surface thereof.

The inlet cryopanel 32 is disposed at a place corresponding to the second-stage cryopanel assembly 20 at the intake port 12. The inlet cryopanel 32 occupies a central portion of the opening area of the intake port 12, and forms an annular (for example, circular ring-shaped) open area 51 between itself and the radiation shield 30. The shape of the inlet cryopanel 32 when viewed in the axial direction is, for example, a disk shape. The diameter of the inlet cryopanel 32 is relatively small and is smaller than the diameter of the second-stage cryopanel assembly 20, for example. The inlet cryopanel 32 may occupy at most ⅓ or at most ¼ of the opening area of the intake port 12. In this way, the open area 51 may occupy at least ⅔ or at least ¾ of the opening area of the intake port 12.

The inlet cryopanel 32 is mounted to the shield front end 36 through an inlet cryopanel mounting member 33. As shown in FIG. 2, the inlet cryopanel mounting member 33 is a linear member that extends over the shield front end 36 along the diameter of the shield main opening 34. In this manner, the inlet cryopanel 32 is fixed to the radiation shield 30 and is thermally coupled to the radiation shield 30. The inlet cryopanel 32 is adjacent to, but not in contact with, the second-stage cryopanel assembly 20. Further, the inlet cryopanel mounting member 33 divides the open area 51 in the circumferential direction. The open area 51 is composed of a plurality of (for example, two) arc-shaped areas. The inlet cryopanel mounting member 33 may have a cross shape or another shape.

The inlet cryopanel 32 is disposed at the central portion of the intake port 12. The center of the inlet cryopanel 32 is located on the central axis C. However, the center of the inlet cryopanel 32 may be located somewhat off the central axis C, and also in such a case, the inlet cryopanel 32 can be regarded as being disposed at the central portion of the intake port 12. The inlet cryopanel 32 is disposed perpendicular to the central axis C. Further, in the axial direction, the inlet cryopanel 32 is disposed slightly above the shield front end 36. However, the inlet cryopanel 32 may be disposed at substantially the same height as the shield front end 36 in the axial direction, or slightly below the shield front end 36 in the axial direction.

The first-stage cryopanel 18 further includes a first-stage extended cryopanel 48 disposed on an outer peripheral portion of the intake port 12. The first-stage extended cryopanel 48 is an annular member that is disposed above the shield front end 36 in the axial direction and extends in the circumferential direction along the shield front end 36. An outer diameter of the first-stage extended cryopanel 48 is located outside the shield front end 36 in the radial direction. The inner diameter of the first-stage extended cryopanel 48 may be located at substantially the same radial position as the shield front end 36 or slightly inside the shield front end 36 in the radial direction. The open area 51 is formed between the inner diameter of the first-stage extended cryopanel 48 and the inlet cryopanel 32. The center of the first-stage extended cryopanel 48 is located on the central axis C, but may be located slightly off the central axis C. The first-stage extended cryopanel 48 is disposed perpendicular to the central axis C. The first-stage extended cryopanel 48 is disposed at the same height as the inlet cryopanel 32 in the axial direction, but may be disposed at a different height.

The first-stage extended cryopanel 48 is fixed to and thermally coupled to the shield front end 36 through a plurality of mounting blocks 49 fixed to the shield front end 36. The mounting blocks 49 are protrusion parts that protrude inward in the radial direction and upward in the axial direction from the shield front end 36, and are formed at equal intervals (for example, every 90° or 60°) in the circumferential direction. The first-stage extended cryopanel 48 is fixed to the mounting block 49 by a fastening member such as a bolt or any other appropriate method. At least one mounting block 49 may be used to fix the inlet cryopanel mounting member 33 to the shield front end 36.

In this manner, each of the inlet cryopanel 32 and the first-stage extended cryopanel 48 is thermally coupled to the first cooling stage 22 through the radiation shield 30. Therefore, the inlet cryopanel 32 and the first-stage extended cryopanel 48 are cooled to the first cooling temperature, similarly to the radiation shield 30. The first-stage extended cryopanel 48 can condense the type 1 gas such as water vapor, similarly to the inlet cryopanel 32. By installing the first-stage extended cryopanel 48 in addition to the inlet cryopanel 32, it is possible to enhance the exhaust performance (for example, exhaust speed or occlusion amount) of the type 1 gas of the cryopump 10.

The second-stage cryopanel assembly 20 is provided at the central portion of the internal space 14 of the cryopump 10. The second-stage cryopanel assembly 20 includes an upper structure **20*a* and a lower structure 20*b*. The second-stage cryopanel assembly 20 includes a plurality of adsorption cryopanels 60 arranged in the axial direction. The plurality of adsorption cryopanels 60** are arranged at intervals in the axial direction.

The upper structure **20*a* of the second-stage cryopanel assembly 20 includes a plurality of upper cryopanels 60*a* and a plurality of heat transfer bodies (also referred to as a heat transfer spacers). The plurality of upper cryopanels 60*a* are disposed between the inlet cryopanel 32 and the second cooling stage 24 in the axial direction. The plurality of heat transfer bodies are arranged in a columnar shape in the axial direction. The plurality of upper cryopanels 60*a* and the plurality of heat transfer bodies are alternately stacked in the axial direction between the intake port 12 and the second cooling stage 24. The centers of the upper cryopanel 60***a* and the heat transfer body are located together on the central axis C. In this way, the upper structure 20*a* is disposed above the second cooling stage 24 in the axial direction. The upper structure 20*a* is fixed to the second cooling stage 24 through a heat transfer block 63 formed of a high heat conductive metal material such as copper (for example, pure copper), and is thermally coupled to the second cooling stage 24. Therefore, the upper structure 20*a* is cooled to the second cooling temperature.

The lower structure 20*b* of the second-stage cryopanel assembly 20 includes a plurality of lower cryopanels 60*b* and a second-stage cryopanel mounting member 64. The plurality of lower cryopanels 60*b* are disposed between the second cooling stage 24 and the shield bottom portion 38 in the axial direction. The second-stage cryopanel mounting member 64 extends downward in the axial direction from the second cooling stage 24. The plurality of lower cryopanels 60*b* are mounted to the second cooling stage 24 through the second-stage cryopanel mounting members 64. In this way, the lower structure 20*b* is thermally coupled to the second cooling stage 24 and is cooled to the second cooling temperature.

As an example, one or a plurality of upper cryopanels 60*a* that are closest to the inlet cryopanel 32 in the axial direction, among the plurality of upper cryopanels 60*a*, are flat plates (for example, disk-shaped) and are disposed perpendicular to the central axis C. The remaining upper cryopanels 60*a* have an inverted truncated cone shape, and a circular bottom surface is disposed perpendicular to the central axis C.

The upper cryopanel 60*a* closest to the inlet cryopanel 32 (that is, the upper cryopanel 60*a* located immediately below the inlet cryopanel 32 in the axial direction, also referred to as a top cryopanel 61), among the upper cryopanels 60*a*, has a diameter larger than that of the inlet cryopanel 32. However, the diameter of the top cryopanel 61 may be equal to or smaller than the diameter of the inlet cryopanel 32. The top cryopanel 61 and the inlet cryopanel 32 directly face each other, and no other cryopanel exists between the top cryopanel 61 and the inlet cryopanel 32.

The diameters of the plurality of upper cryopanels 60*a* gradually increase toward the lower side in the axial direction. Further, the inverted truncated cone-shaped upper cryopanel 60*a* is disposed in a nested manner. The lower part of the upper cryopanel 60*a* on the higher side enters the inverted truncated conical space in the upper cryopanel 60*a* adjacent thereunder.

Each heat transfer body has a columnar shape. The heat transfer body may have a relatively short columnar shape and may have an axial height smaller than the diameter of the heat transfer body. The cryopanel such as the adsorption cryopanel 60 is generally formed of a high heat conductive metal material such as copper (for example, pure copper), and as necessary, the surface thereof is coated with a metal layer such as nickel. In contrast, the heat transfer body may be formed of a material different from that of the cryopanel. The heat transfer body may be formed of a metal material, such as aluminum or an aluminum alloy, for example, having a lower density although it has a lower thermal conductivity than the adsorption cryopanel 60. In this way, both the thermal conductivity and the reduction in weight of the heat transfer body can be achieved to some extent, which is helpful to reduce the cooling time of the second-stage cryopanel assembly 20.

The lower cryopanel 60*b* is a flat plate, for example, in a disk shape. The lower cryopanel 60*b* has a larger diameter than the upper cryopanel 60*a*. However, a cutout portion from a part of the outer periphery to the central portion may be formed in the lower cryopanel 60*b* for the mounting to the second-stage cryopanel mounting member 64.

The specific configuration of the second-stage cryopanel assembly 20 is not limited to the configuration described above. The upper structure 20*a* may have any number of upper cryopanels 60*a*. The upper cryopanel 60*a* may have a flat plate shape, a conical shape, or other shapes. Similarly, the lower structure 20*b* may have any number of lower cryopanels 60*b*. The lower cryopanel 60*b* may have a flat plate shape, a conical shape, or other shapes.

In the second-stage cryopanel assembly 20, an adsorption area 66 is formed on at least a part of the surface. The adsorption area 66 is provided, for capturing a non-condensable gas (for example, hydrogen) by adsorption. The adsorption area 66 is formed for example, by bonding an adsorbent (for example, activated carbon) to the surface of the cryopanel. The adsorption area 66 may be formed in a place that is hidden behind the adsorption cryopanel 60 adjacent to the upper side so as not to be seen from the intake port 12. For example, the adsorption area 66 is formed on the entire lower surface of the adsorption cryopanel 60. The adsorption area 66 may be formed on the upper surface of the lower cryopanel 60*b*. Further, although not shown in FIG. 1 for simplicity, the adsorption area 66 is also formed on the lower surface (back surface) of the upper cryopanel 60*a*. As necessary, the adsorption area 66 may be formed on the upper surface of the upper cryopanel 60*a*.

Since the second-stage cryopanel assembly 20 has a large number of adsorption cryopanels 60, it has high exhaust performance with respect to the type 3 gas. For example, the second-stage cryopanel assembly 20 can exhaust a hydrogen gas at a high exhaust speed.

In the adsorption area 66, a large number of activated carbon particles are bonded in an irregular arrangement in a state of being densely arranged on the surface of the adsorption cryopanel 60. The activated carbon particles are molded, for example, in a columnar shape. The shape of the adsorbent may not be a columnar shape and may be, for example, a spherical shape, another molded shape, or an irregular shape. The arrangement of the adsorbents on the panel may be a regular arrangement or an irregular arrangement.

Further, a condensation area for capturing a condensable gas by condensation is formed on at least a part of the surface of the second-stage cryopanel assembly 20. The condensation area is, for example, a section where the adsorbent is missing on the surface of the cryopanel, and the surface of the cryopanel base material, for example, the metal surface is exposed. The upper surface, the outer peripheral portion of the upper surface, or the outer peripheral portion of the lower surface of the adsorption cryopanel 60 (for example, the upper cryopanel 60*a*) may be a condensation area.

The second-stage cryopanel assembly 20 further includes a condensation cryopanel 68 disposed to surround the upper structure 20*a*, and a condensation cryopanel mounting member 69 for thermally and structurally coupling the condensation cryopanel 68 to the second cooling stage 24.

Figure 3:
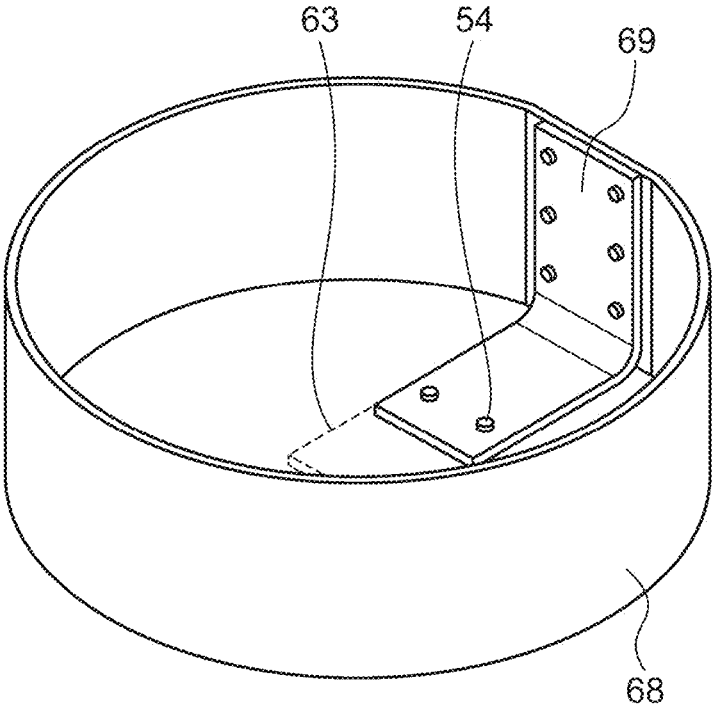
FIG. 3 is a schematic perspective view showing a condensation cryopanel of a second-stage cryopanel assembly according to the embodiment.

FIG. 3 is a schematic perspective view showing the condensation cryopanel 68 of the second-stage cryopanel assembly 20 according to the embodiment. In FIG. 3, the condensation cryopanel mounting member 69 is also shown together with the condensation cryopanel 68. For easy understanding, the heat transfer block 63 is shown by a broken line in FIG. 3.

As shown in FIGS. 1 to 3, the condensation cryopanel 68 has a tubular shape, for example, a cylindrical shape, which extends in the axial direction and is open at both ends. The condensation cryopanel 68 is disposed between the radiation shield 30 and the plurality of adsorption cryopanels 60 in the radial direction and is thermally coupled to the second cooling stage 24.

The adsorption cryopanel 60 has the adsorption area 66, as described above, whereas the condensation cryopanel 68 does not have the adsorption area 66. That is, the condensation cryopanel 68 is not provided with an adsorbent. The condensation cryopanel 68 is formed of a high heat conductive metal material such as copper (for example, pure copper), like other cryopanels. The surface of the condensation cryopanel 68 may be coated with another metal layer such as nickel.

The condensation cryopanel 68 is disposed outside in the radial direction with respect to the inlet cryopanel 32. Further, the condensation cryopanel 68 is disposed inside in the radial direction with respect to the first-stage extended cryopanel 48. The condensation cryopanel 68 is exposed in the open area 51 and is visible from above the intake port 12. No cryopanel is provided above the condensation cryopanel 68. The inlet cryopanel mounting member 33 only crosses the condensation cryopanel 68 very locally.

The radial distance from the condensation cryopanel 68 to the inlet cryopanel 32 is larger than the radial distance from the condensation cryopanel 68 to the first-stage extended cryopanel 48. Further, the radial distance from the condensation cryopanel 68 to the upper cryopanel 60*a* is larger than the radial distance from the condensation cryopanel 68 to the shield side portion 40 (or the shield front end 36) of the radiation shield 30. The condensation cryopanel 68 is not in contact with the upper cryopanel 60*a*.

In this way, a relatively wide gas receiving space 50 is formed between the condensation cryopanel 68 and the upper cryopanel 60*a*. The open area 51 is an inlet of the gas receiving space 50, and the cryopump 10 receives gas into the gas receiving space 50 through the open area 51. For this reason, compared to a case where the condensation cryopanel 68 is disposed close to the upper cryopanel 60*a*, the condensation cryopanel 68 is less likely to prevent the gas entering from the intake port 12 from reaching the adsorption cryopanel 60.

The condensation cryopanel 68 extends in the circumferential direction along the shield side portion 40 of the radiation shield 30. However, the condensation cryopanel 68 is close to, but not in contact with, the radiation shield 30. In order to appropriately maintain the temperature difference between the condensation cryopanel 68 and the first-stage cryopanel 18, the radial distance between the condensation cryopanel 68 and the shield side portion 40 may be, for example, at least 3 mm, or at least 5 mm, or at least 7 mm. The radial distance between the condensation cryopanel 68 and the shield side portion 40 may be, for example, within 20 mm, or within 15 mm, or within 10 mm.

The condensation cryopanel 68 extends over the entire circumference around the central axis C. However, there is no limitation thereto. The condensation cryopanel 68 may be provided only partially in the circumferential direction. Further, the condensation cryopanel 68 is disposed coaxially with the central axis C. However, the condensation cryopanel 68 may be disposed somewhat off the central axis C.

The condensation cryopanel 68 is disposed between the inlet cryopanel 32 and the second cooling stage 24 in the axial direction. The upper end in the axial direction of the condensation cryopanel 68 is located, for example, between the top cryopanel 61 and the second upper cryopanel 60*a*. Alternatively, the upper end in the axial direction of the condensation cryopanel 68 may be located between the shield front end 36 and the top cryopanel 61 (or another upper cryopanel 60*a*). The lower end in the axial direction of the condensation cryopanel 68 is located, for example, at substantially the same height as the upper surface of the heat transfer block 63. In this way, almost the entirety of the upper structure 20*a* is surrounded by the condensation cryopanel 68.

The condensation cryopanel mounting member 69 has an L-shape. One surface of the condensation cryopanel mounting member 69 is mounted on the inner surface (or outer surface) of the condensation cryopanel 68. The other surface of the condensation cryopanel mounting member 69 perpendicular to the one surface is mounted on the upper surface of the heat transfer block 63. In this way, the condensation cryopanel 68 is thermally and structurally coupled to the second cooling stage 24 through the condensation cryopanel mounting member 69. It is possible to make the heat transfer path from the second cooling stage 24 to the condensation cryopanel 68 relatively short, and thus it is possible to efficiently cool the condensation cryopanel 68.

As an example, the condensation cryopanel 68 is mounted to the condensation cryopanel mounting member 69 by, for example, rivets or other mounting means. The condensation cryopanel mounting member 69 is mounted to the heat transfer block 63 by using a fastening member 54 such as a bolt, for example. The condensation cryopanel mounting member 69 and the heat transfer block 63 may be fastened together to the second cooling stage 24 by the fastening member 54. With this configuration, the condensation cryopanel mounting member 69 and the heat transfer block 63 can be collectively fastened and fixed to the second cooling stage 24 at a time, so that manufacturing (assembly work) is easy.

The cryopump housing 70 is a casing of the cryopump 10, which accommodates the first-stage cryopanel 18, the second-stage cryopanel assembly 20, and the cryocooler 16, and is a vacuum container configured to maintain the vacuum tightness of the internal space 14. The cryopump housing 70 includes the first-stage cryopanel 18 and the cryocooler structure part 21 in a non-contact manner. The cryopump housing 70 is mounted to the room temperature part 26 of the cryocooler 16.

The intake port 12 is defined by a front end of the cryopump housing 70. The cryopump housing 70 has an intake port flange 72 extending radially outward from a front end thereof. The intake port flange 72 is provided over the entire circumference of the cryopump housing 70. The cryopump 10 is mounted to a vacuum chamber to be evacuated by using the intake port flange 72. A recessed portion is formed on the inner peripheral side of the intake port flange 72 so as to avoid the contact between the intake port flange 72 and the first-stage extended cryopanel 48, and the cryopump 10 is mounted to the vacuum chamber on the upper surface of the flange further on the outer peripheral side than the recessed portion.

The intake port flange 72 can function as a so-called conversion flange. The intake port flange 72 may be configured to mount a relatively small cryopump 10 to an exhaust port of a larger diameter vacuum chamber. For example, the intake port flange 72 may be designed such that a cryopump 10 having an intake port 12 having a 12-inch diameter can be mounted to an exhaust port of a vacuum chamber having a 14-inch or 16-inch diameter, for example.

In FIG. 1, the inlet cryopanel 32 and the first-stage extended cryopanel 48 are located slightly above the flange upper surface of the intake port flange 72 in the axial direction. However, there is no limitation thereto. For example, the flange upper surface may be located above the first-stage extended cryopanel 48 in the axial direction, and the first-stage extended cryopanel 48 may be accommodated in the inner peripheral side recessed portion of the intake port flange 72.

The operation of the cryopump 10 having the above configuration will be described below. When the cryopump 10 is operated, first, the interior of the vacuum chamber is roughed to about 1 Pa with another appropriate roughing pump before the operation. Thereafter, the cryopump 10 is operated. The first cooling stage 22 and the second cooling stage 24 are respectively cooled to the first cooling temperature and the second cooling temperature by the driving of the cryocooler 16. Accordingly, the first-stage cryopanel 18 and the second-stage cryopanel assembly 20 thermally coupled to these are also respectively cooled to the first cooling temperature and the second cooling temperature.

The inlet cryopanel 32 and the first-stage extended cryopanel 48 cool the gas which comes flying from the vacuum chamber toward the cryopump 10. A gas having a sufficiently low vapor pressure (for example, $10^{-8}$ Pa or less) at the first cooling temperature condenses on the surfaces of the inlet cryopanel 32 and the first-stage extended cryopanel 48. This gas may be referred to as a type 1 gas. The type 1 gas is, for example, water vapor. In this way, the inlet cryopanel 32 and the first-stage extended cryopanel 48 can exhaust the type 1 gas. Apart of a gas in which vapor pressure is not sufficiently low at the first cooling temperature enters the internal space 14 from the intake port 12. Alternatively, the other part of the gas is reflected by the inlet cryopanel 32 and does not enter the internal space 14.

The gas that has entered the internal space 14 is cooled by the second-stage cryopanel assembly 20. A gas having a sufficiently low vapor pressure (for example, $10^{-8}$ Pa or less) at the second cooling temperature condenses on the surface of the condensation cryopanel 68. This gas may be referred to as a type 2 gas. The type 2 gas is, for example, nitrogen ($N_2$) or argon (Ar). The type 2 gas is also condensed in the condensation area of the adsorption cryopanel 60. In this way, the second-stage cryopanel assembly 20 can exhaust the type 2 gas.

A gas in which vapor pressure is not sufficiently low at the second cooling temperature is adsorbed by the adsorption area 66 of the adsorption cryopanel 60. This gas may be referred to as a type 3 gas. The type 3 gas is, for example, hydrogen ($H_2$). In this way, the second-stage cryopanel assembly 20 can exhaust the type 3 gas. Therefore, the cryopump 10 can exhaust various gases by condensation or adsorption and can make the degree of vacuum of the vacuum chamber reach a desired level.

According to the cryopump 10 according to the embodiment, the condensation cryopanel 68 is provided, whereby it is possible to improve the exhaust performance (for example, exhaust speed or occlusion amount) of the type 2 gas. Further, since the condensation cryopanel 68 has a tubular shape and the upper end in the axial direction is open, the enter path of the type 3 gas into the adsorption cryopanel 60 of the upper structure 20*a* surrounded by the condensation cryopanel 68 is not easily obstructed. Further, since the lower end in the axial direction of the condensation cryopanel 68 is also open, the gas can also reach the adsorption cryopanel 60 of the lower structure 20*b*. Accordingly, a decrease in the exhaust performance of the type 3 gas due to the addition of the condensation cryopanel 68 to the cryopump 10 is sufficiently suppressed. Therefore, the cryopump 10 can improve the exhaust performance of the type 2 gas while realizing the high-speed exhaust of the type 3 gas.

Further, the condensation cryopanel 68 is disposed outside in the radial direction with respect to the inlet cryopanel 32. Therefore, the enter path of the gas flowing from the outside of the cryopump 10 toward the condensation cryopanel 68 is hardly obstructed by the inlet cryopanel 32, so that the exhaust performance of the type 2 gas of the condensation cryopanel 68 can be utilized.

The condensation cryopanel 68 is disposed between the inlet cryopanel 32 and the second cooling stage 24 in the axial direction. In this manner, the condensation cryopanel 68 is disposed relatively on the upper side in the axial direction. For this reason, the type 2 gas flowing in from the intake port 12 can easily reach the condensation cryopanel 68 as compared with a case where the condensation cryopanel 68 is disposed below. The exhaust performance of the condensation cryopanel 68 can be enhanced.

Figure 4:
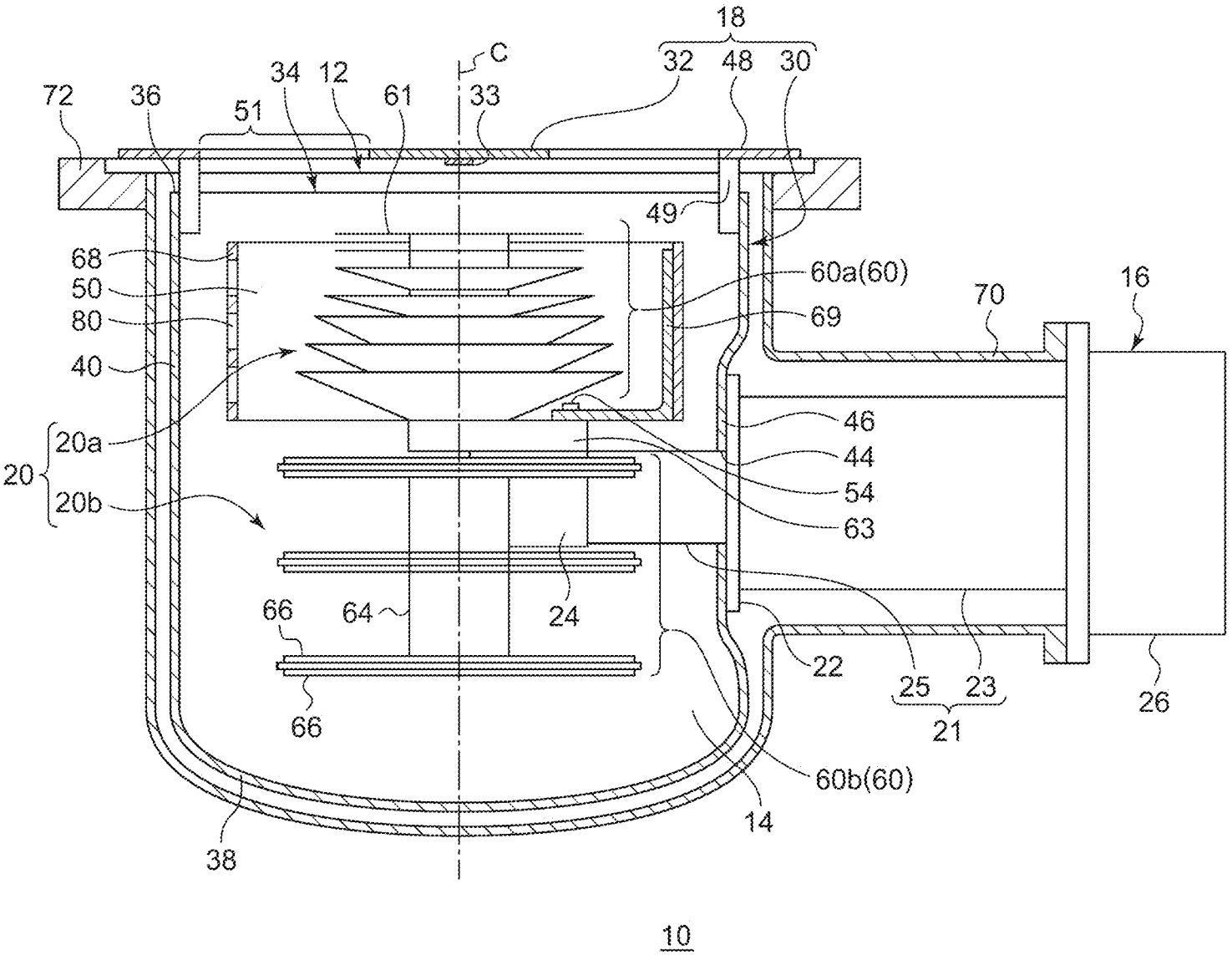
FIG. 4 is a side sectional view schematically showing a cryopump according to another embodiment.
Figure 5:
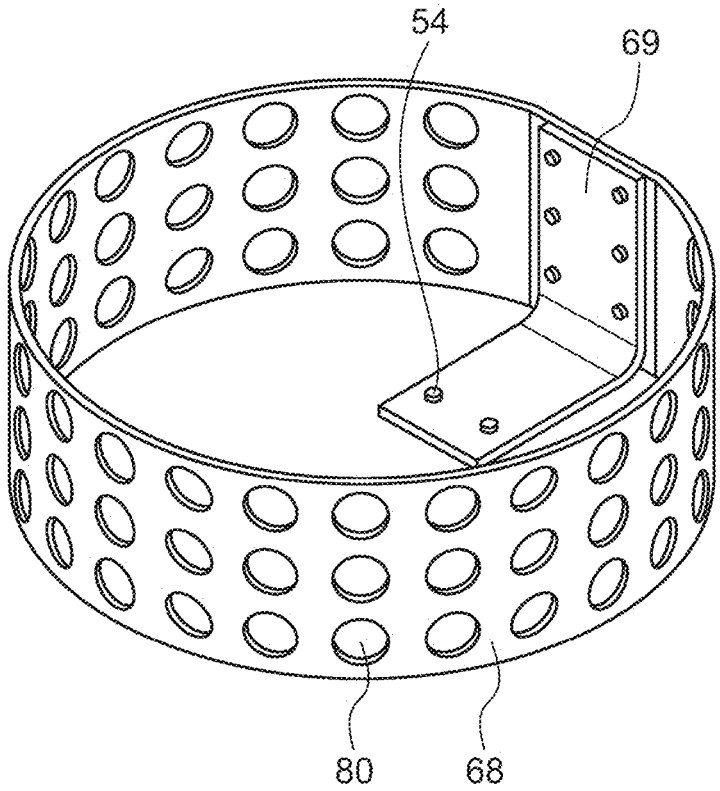
FIG. 5 is a schematic perspective view showing a condensation cryopanel of a second-stage cryopanel assembly according to another embodiment.

FIG. 4 is a side sectional view schematically showing a cryopump 10 according to another embodiment. FIG. 5 is a schematic perspective view showing the condensation cryopanel 68 of the second-stage cryopanel assembly 20 according to another embodiment. The embodiment which is described with reference to FIGS. 4 and 5 is the same as the above-described embodiment except for the configuration of the condensation cryopanel 68. In the following description, the same configurations as those in the above-described embodiment are denoted by the same reference numerals, and overlapping description is appropriately omitted.

The condensation cryopanel 68 has a large number of holes 80. As an example, the holes 80 are all circular holes having the same diameter. Three holes 80 are provided in the axial direction, and in the circumferential direction, the holes 80 are provided in the entire circumference except for the position of the condensation cryopanel mounting member 69. The condensation cryopanel 68 is made by forming a punching metal into a cylindrical shape. The shape of the hole 80 may be any shape. For example, the hole 80 may be a slit extending in the circumferential direction (or the axial direction). All the holes 80 does not need to have the same shape. Further, the arrangement of the holes 80 may be any arrangement, and may be a regular arrangement or an irregular arrangement.

In this manner, the condensation cryopanel 68 has a large number of holes 80, whereby it is possible to make the radiant heat entering from the intake port 12 incident on the radiation shield 30 through the holes 80 and make the radiant heat pass through the condensation cryopanel 68. The heat entering the condensation cryopanel 68 can be reduced, and thus a desired cooling temperature can be easily maintained.

Preferably, the condensation cryopanel 68 has an aperture ratio in a range of 20% to 40%, for example. The condensation cryopanel 68 may have an aperture ratio in a range of 25% to 35%, or an aperture ratio of about 30%. The aperture ratio is the ratio of the total area of the holes 80 to the total area (for example, the area of the cylindrical surface) of the condensation cryopanel 68. The total area of the condensation cryopanel 68 includes the area of the hole 80.

The aperture ratio of the condensation cryopanel 68 is determined in this manner, whereby it is possible to achieve both the exhaust performance and the measures against intrusion heat. According to the estimation by the inventor of the present invention, a decrease in the exhaust speed of a hydrogen gas can be suppressed to 5% or less as compared with a case where the condensation cryopanel 68 is not installed.

The present invention has been described above based on the examples. It will be understood by those skilled in the art that the present invention is not limited to the embodiments described above, various design changes can be made, various modification examples can be made, and such modification examples are also within the scope of the present invention.

In the embodiments described above, the condensation cryopanel 68 is disposed between the inlet cryopanel 32 and the second cooling stage 24 in the axial direction and is located at a relatively higher position in the axial direction in the internal space 14 of the cryopump 10. However, there is no limitation thereto. The condensation cryopanel 68 may be disposed between the second cooling stage 24 and the shield bottom portion 38 in the axial direction. The condensation cryopanel 68 may be disposed so as to surround the lower structure 20*b* of the second-stage cryopanel assembly 20.

In the embodiments described above, the condensation cryopanel 68 has a cylindrical surface coaxial with the central axis C, that is, has a surface orthogonal to a plane perpendicular to the central axis C. However, there is no limitation thereto. The condensation cryopanel 68 may be slightly inclined with respect to a plane perpendicular to the central axis C. For example, the condensation cryopanel 68 may have a shape of a truncated cone or an inverted truncated cone disposed coaxially with the central axis C. Also in this case, the condensation cryopanel 68 may have a plurality of holes 80. Alternatively, the condensation cryopanel 68 may not have holes.

In the embodiments described above, the condensation cryopanel 68 is a single cylinder. However, there is no limitation thereto, and the condensation cryopanel 68 may be, for example, a double cylinder. In this manner, the second-stage cryopanel assembly 20 may have a plurality of condensation cryopanels 68 arranged in the radial direction. Also in this case, the condensation cryopanel 68 may have a plurality of holes 80. Alternatively, the condensation cryopanel 68 may not have holes.

In the above description, the horizontal cryopump has been exemplified. However, the present invention is also applicable to other vertical cryopumps. The vertical cryopump refers to a cryopump in which the cryocooler 16 is disposed along the central axis C of the cryopump 10. Further, the internal configuration of the cryopump, such as the arrangement, the shape, the number, or the like of a cryopanel, is not limited to the specific embodiment described above. Various known configurations can be appropriately adopted.

The present invention can be used in the field of a cryopump.

It should be understood that the invention is not limited to the above-described embodiment, but may be modified into various forms on the basis of the spirit of the invention. Additionally, the modifications are included in the scope of the invention.

What is claimed is:

1. A cryopump comprising:

a cryocooler which includes a high-temperature cooling stage and a low-temperature cooling stage;

a radiation shield which surrounds the low-temperature cooling stage, extends in an axial direction, and is thermally coupled to the high-temperature cooling stage;

a plurality of adsorption cryopanels which are disposed between a cryopump intake port and the low-temperature cooling stage in the axial direction and are thermally coupled to the low-temperature cooling stage; and a condensation cryopanel which is disposed between the radiation shield and the plurality of adsorption cryopanels in a radial direction, is thermally coupled to the low-temperature cooling stage, and has a tubular shape extending in the axial direction and being open at both ends.

2. The cryopump according to claim 1, wherein the condensation cryopanel is disposed between the cryopump intake port and the low-temperature cooling stage in the axial direction.

3. The cryopump according to claim 1, wherein the cryopump intake port has an open area which is located above the condensation cryopanel in the axial direction.

4. The cryopump according to claim 1, further comprising:

an inlet cryopanel disposed at a central portion of the cryopump intake port and thermally coupled to the high-temperature cooling stage, wherein the plurality of adsorption cryopanels are disposed between the inlet cryopanel and the low-temperature cooling stage in the axial direction, and the condensation cryopanel is disposed outside the inlet cryopanel in the radial direction.

5. The cryopump according to claim 4, wherein the condensation cryopanel is disposed between the inlet cryopanel and the low-temperature cooling stage in the axial direction.

6. The cryopump according to claim 4, wherein the cryopump intake port has an annular open area formed between the inlet cryopanel and the radiation shield, and the annular open area is located above the condensation cryopanel in the axial direction.

7. The cryopump according to claim 1, wherein a radial distance from the condensation cryopanel to the plurality of adsorption cryopanels is larger than a radial distance from the condensation cryopanel to the radiation shield.

8. The cryopump according to claim 1, wherein the condensation cryopanel has a large number of holes.

9. The cryopump according to claim 8, wherein the condensation cryopanel has an aperture ratio in a range from 20% to 40%.

* * * * *